United States Patent [19]

Pedersen

[11] 4,188,790

[45] Feb. 19, 1980

[54] HYDRAULIC SYSTEM FOR OPERATION OF A WINCH

[75] Inventor: Håkon S. Pedersen, Bergen, Norway

[73] Assignee: A/S Bergens Mekaniske Verksteder, Bergen, Norway

[21] Appl. No.: 948,551

[22] Filed: Oct. 4, 1978

Related U.S. Application Data

[63] Continuation of Ser. No. 837,090, Sep. 28, 1977, abandoned, which is a continuation of Ser. No. 721,416, Sep. 8, 1976, abandoned, which is a continuation of Ser. No. 550,617, Feb. 18, 1975, abandoned.

[30] Foreign Application Priority Data

Feb. 21, 1974 [NO] Norway ..... 740589

[51] Int. Cl.[2] ..... F15B 13/06; F15B 13/09

[52] U.S. Cl. ..... 60/483; 60/486; 60/905; 254/172

[58] Field of Search ..... 60/483, 484, 485, 905; 91/508; 254/172; 74/661, 665 R

[56] References Cited

U.S. PATENT DOCUMENTS

| | | | |
|---|---|---|---|
| 3,757,524 | 9/1973 | Poyner et al. | 60/905 X |
| 3,768,263 | 10/1973 | Olson et al. | 60/483 X |

*Primary Examiner*—Edgar W. Geoghegan
*Attorney, Agent, or Firm*—Young & Thompson

[57] ABSTRACT

Hydraulic system for operation of a winch, including a hydraulic motor for operation of the winch, a pump for pumping hydraulic oil for operation of the motor, a manoeuvering valve for control of the speed of the motor and rotational direction, a first choke valve which is connected in series with the pump, and a second choke valve which is connected in parallel with the motor, the system including two or more hydraulic motors connected in parallel, with throughflow both ways, preferably of the multi-stage type, and drive-connected to the same winch shaft.

2 Claims, 1 Drawing Figure

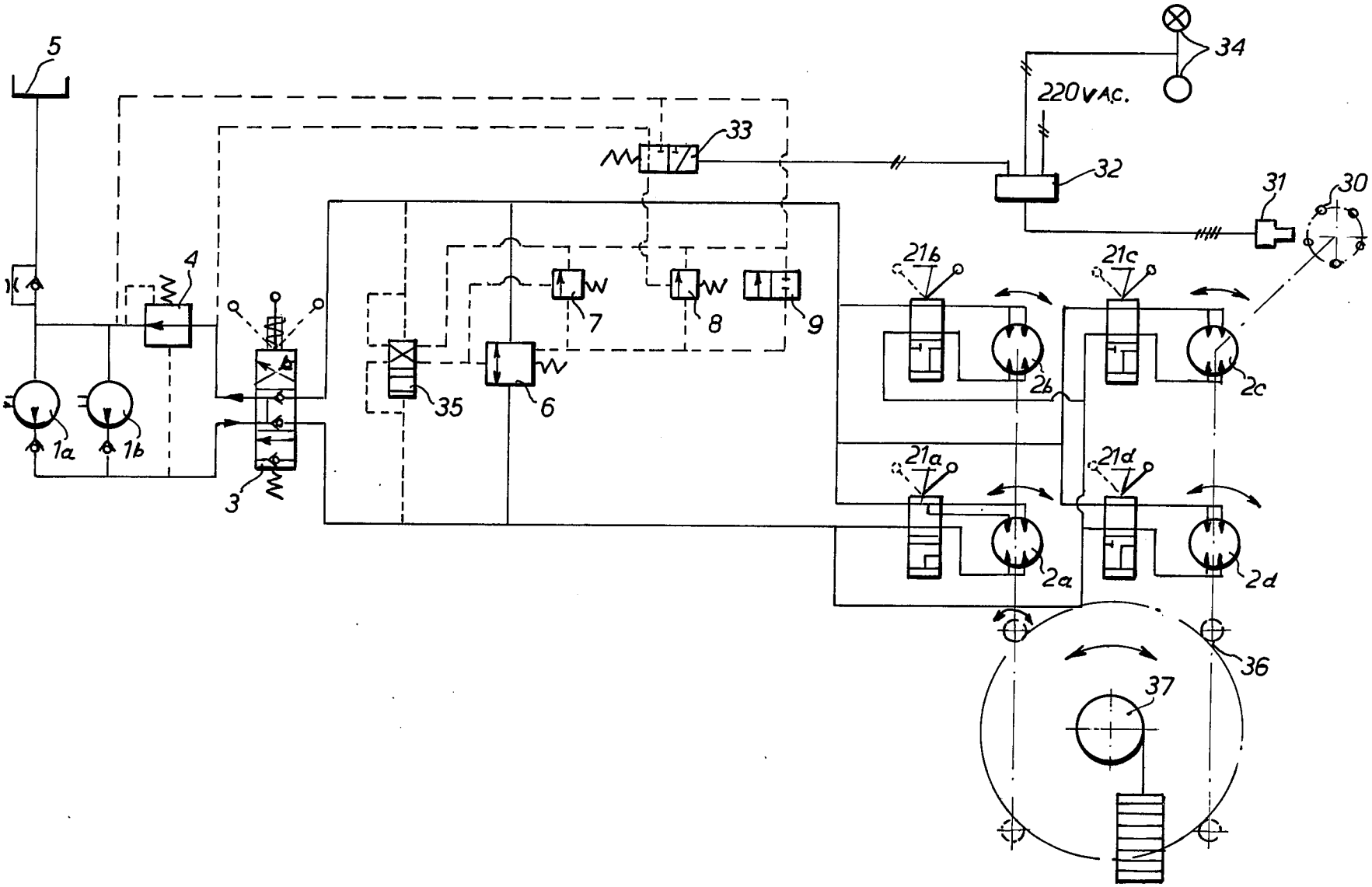
30
31
34
220VAC.
32
2c
2d
36
37
21c
21d
2b
2a
21b
21a
9
33
8
7
6
35
3
4
1b
1a
5

HYDRAULIC SYSTEM FOR OPERATION OF A WINCH

This is a continuation application Ser. No. 837,090, filed Sept. 28, 1977, now abandoned which is a continuation of Ser. No. 721,416, filed Sept. 8, 1976, now abandoned which is a continuation of Ser. No. 550,617, filed Feb. 18, 1975, now abandoned.

The invention relates to a hydraulic system for operation of a winch or the like, where hydraulic braking is necessary.

The band brakes frequently used on winches are difficult to adjust due to their tendency to self tightening, a condition which is aggravated by the arc of contact. The braking effect which is converted to heat requires further expensive arrangements for effective water cooling with the corrosion problems this entails. Use of disc brakes is somewhat more advantageous since the cooling property is better and the friction elements have a longer lifetime and are simpler to replace. However, disc brakes are relatively expensive.

There are also winches which are provided with regenerative braking, i.e. in which the electric motor, when the winch is electrically operated, and the generator exchange places so that the winch becomes a driving part, the energy being returned to the motor. This system also has its limitations since there is frequently no possibility of transferring all the braking energy to the drive motor. Onboard ships, this problem has been solved by conveying the braking energy to the propeller shaft via a gear. In practice, this is an extremely expensive solution.

Regenerative braking can also be achieved in hydraulically driven winches where a motor with fixed stroke volume is operated by a pump with variable stroke volume. During braking, the motor acts as pump and delivers the hydraulic oil to the winch pump which then acts as motor. Here also the problem of absorbing returned effect arises and, as a rule, it is necessary onboard ship to effect the apparatus such that the variable pump is driven by the main motor.

A hydraulic system which is particularly developed for wire winches is known which can, however, also be used for towing winches, anchor winches and hauling winches where hydraulic braking is necessary. This last said system is based on the fact that the hydraulic motor, during lowering of the load, acts as brake, in that the pump of the system then acts as feed pump for the motor, and an amount of oil corresponding to the oil delivery of the pump is choked in a pressure reduction valve between motor and pump. The energy is thereby converted to heat which is supplied to the hydraulic system such that the energy is not returned to the operating machine. An overflow valve is adapted to open at different, adjustable opening pressures determined by the choking in the manoeuvering valve, so that the braking factor of the motor can be adjusted continuously and the system, with the manoeuvering valve in outer position for braking, gives automatic control with a desired low braking factor, determined by a first pilot valve, the system giving automatic control, also with the manoeuvering valve in stop position, determined by a second pilot valve with desired maximum braking factor on final braking. The present invention is based on the last said system and is particularly developed in consideration of the special problems arising within the offshore sector, particularly when laying out anchors from drilling platforms.

On laying out anchors from drilling platforms, the anchor is secured to the stern of the supply boat. The chain is suspended in a loop from the chain hawse of the drilling platform to the supply boat. The supply boat sets course towards the location where the anchor is to be dropped, the chain running from the chain edge on the drilling platform over the messenger of the anchor winch and the messenger brakes with a suitable, adjustable braking force. If the braking factor is too small, the chain gives too great friction against the bottom so that the propelling force of the supply boat is no longer sufficient to propel the boat forwards. If the braking factor is too great, the horizontal chain tension component will be in excess of the propelling force of the vessel.

It is, therefore, of great importance that the braking factor can be adjusted in a satisfactory manner. The braking effects involved depend on the total length of the chain and weight per running meter, the propelling force of the supply boat and the speed, etc., and can be as much as several thousand hp.

When the supply boat has arrived at the position where the anchor is to be dropped, the anchor is lowered suspended by a wire which is wound off the anchor handling drum on the winch abroad the supply boat. The braking effect is of great importance in this operation also.

Conventional band brakes are not very suitable for such use, and the same applies to disc brakes. This is due, in part, to the unfavourable qualities of these brake types, for example, the tendency to self tightening in the band brake and the great heat development.

A hydraulic system of the type previously described, which includes a hydraulic motor for operation of the winch, with a pump for pumping hydraulic oil for operation of the motor, a manoeuvering valve for control of the speed of the motor and rotational direction, and with a choke valve which is connected in series with the pump and a second choke valve which is connected in parallel with the motor, can be used since, with such a system, the advantage is achieved that the motor, when acting as brake, can operate with a greater r.p.m. at the same time as the pump can be operated with constant r.p.m., which simplifies the apparatus. A more elastic system wherein it is possible to undertake stage selection is desirable, however.

In accordance with the invention, it is, therefore, proposed to operate the winch with a plurality of hydraulic motors connected in parallel which, in hauling operations with full hauling force, rotate with only a part of their maximum r.p.m., determined by available pump effect, so that the motors, on lowering the anchor and chain, can act as pumps and brake the load with an adjustable effect restricted upwardly by the maximum r.p.m. and pressure of the motors. The r.p.m. and pressure are restricted, in turn, by the pilot-controlled valves. The effect which is converted to heat is conducted via coolers to the degree necessary.

Such a system is elastic. An example from so-called anchor handling from drilling platforms will illustrate this.

When a drilling platform is to be moved, the supply boat must raise the anchor and chain; and to do this, a wire secured to a buoy is transferred to the anchor handling drum. It may be that the anchor and chain are embedded in a thick layer of sand and sludge on the sea bed. The uprooting of the anchor and chain does not depend alone on the weight of the anchor together with a part of the chain, and the maximum pulling force of the winch should, therefore, be, for example, 100 to 200 tons. The available pump effect gives, therefore, a relatively modest heaving speed at maximum hauling force, for example 6 meters per minute.

In bad weather, the movements of the vessel when uprooting the anchor require great care in order to prevent uncontrolled strains. In actual fact, it will be the capability of the winch to pay out on overloading which, in many cases, sets the limits for the conditions under which the anchor handling can be carried out.

The present invention means that the winch can pay out wire, when the stern of the boat is lifted on a wave and a manoeuvering valve lever is maintained in heave position, at a sufficient rate, for example, 100 meters per minute, since the motors, which in the direction of heave at full hauling force rotate only with a part of their maximum r.p.m., restricted by the pump effect, are capable of rotating in reverse direction at their maximum r.p.m. The sum of the oil amount delivered by the actual pump plus the oil amount delivered by the motors coupled in parallel can flow over the pilot-controlled valves.

The present invention means that the winch may be operated via simple gear wheel transference. Several gears on the motors coupled in parallel can be in engagement with a common gear wheel. The gear module may, therefore, be relatively small.

Of decisive importance is the fact that the mechanical efficiency of the winch is obviously improved the fewer the subsequent mechanical transmissions are. The relation between paying out force and hauling force can be kept to an acceptable level. A further important factor is that the relatively low r.p.m. of the motors and the relatively modest gear module substantially reduce the kenetic forces involved which would otherwise give shock loading on reversal of the rotational direction of the winch.

In that the paying out force is held down to an acceptable level and in that the motors and valves are dimensioned for the actual oil amounts on paying out, the paying out force produced by the lifting of the stern of the boat on a wave can be connected to the uprooting of anchor and chain. That is to say that the hauling force of the winch can be reduced.

There is also a possibility of stage selection inasmuch as the winch is operated by several motors coupled in parallel which can be short-circuited. If multi-stage motors are used, it is possible also to short-circuit one or more chambers.

The number of possible hydraulic speed stages will be the number of motors multiplied by the number of chambers in each motor. Thus, four two-stage motors give eight speed stages, four one-stage motors give four speed stages, and two three-stage motors can give six speed stages.

Obviously, one or more one-stage motors can be connected in parallel with one or more multi-stage motors.

A one-stage motor and a two-stage motor will give three speed stages.

The stroke volumes of the motors and the tooth numbers of the gears can, of course, be different in the cases where this is expedient.

If desired, the motors can be operated by one or more one-stage or multi-stage pumps. Pumps with variable stroke volume, or pumps driven by pole reversible electric motors can be used, so that the stage selection can be further increased and, optionally, the pump delivery within each stage can be varied.

Two or more winches which can be driven separately with respective pump/pumps can be given increased speed in that the sum of the oil delivery of the pumps by connection in series is conveyed through the respective manoeuvering valves.

The system means that all components are adapted for both directions of rotation in regard to heave and both directions of rotation in regard to braking.

The valve arrangement can to advantage be effected such that at least one motor has a manoeuvering valve flanged thereupon which, in the case of a multi-stage motor, preferably includes a stage valve which can select one or more stages on the motor on which the manoeuvering valve is flanged. Stage valves are flanged onto the other motors, said valves connecting and disconnecting the motor.

A possibility is to flange a stage valve onto the other motors which valve selects one or more stages on the motor concerned. The stage selector valve can be manually actuated but can, if desired, be controlled by the system pressure by means of pressure-controlled switching relays.

By draining the motor safety valve, the motors can pay out substantially without pressure. It is not necessary for the winch to be provided with friction coupling, therefore. A provision is that the motors and safety valves are dimensioned to the oil amounts occurring on paying out.

The invention is further explained in the following with reference to the drawing which illustrates an embodiment example in the form of a typical coupling diagram which may naturally be varied within the possibilities of the known hydraulic theories.

The system is provided with two pumps 1*a* and 1*b*. These may be operated by an electric motor, a diesel motor or another suitable power source, and deliver hydraulic oil to hydraulic motors 2*a*, 2*b*, via a manoeuvering valve 3. The hydraulic motors 2*a*, 2*b* are connected in parallel and are drive-connected to the same winch shaft.

The hydraulic motors are preferably of the multi-stage type and the system then includes stage valves whereby one or more stages in the separate motors can be connected.

The r.p.m of the hydraulic motor is determined by choke control, in that the oil amount conveyed through the by-pass-channels of the manoeuvering valve can be controlled continuously from full pump delivery to zero. The rotational direction of the hydraulic motor is reversed by reversing flow in the pipelines.

The system is provided with a pressure reduction valve 4 the task of which is to allow controlled lowering of the load when the manoeuvering valve lever is moved to outer position lower. The slide of the pressure reduction valve, when the manoeuvering valve lever is in stop position, is maintained in open position by the circulation pressure of the pump which will act against a relatively weak spring plus a pressure determined by the height difference of the expansion tank 5.

On a heavy operation, the slide of the pressure reduction valve will also be kept open by the pump pressure, so that return oil from the motors 2*a* and 2*b* flows freely back to the pumps 1*a*, 1*b*.

On a lowering operation, the manoeuvering slide 3 gradually exposes the return channel of the manoeuvering valve and choses pressure oil from the hydraulic motor or motors 2a, 2b, which are then, by the load, driven as pump/pumps. The r.p.m. of the hydraulic motor or motors is, in this manner, controlled continuously corresponding to an oil amount from zero up to the actual oil delivery of the pump. The part of the oil delivery of the actual pump which flows through the by-pass-channel of the manoeuvering valve will decrease correspondingly at the same time.

If the manoeuvering valve is returned to outer position, the slide of the manoeuvering valve exposes the return channel of the manoeuvering valve. The pressure is then transferred to the pressure reduction valve and the lowest adjusted pilot valve 8 on the overflow valve.

The pressure reduction valve then chokes an oil amount from the hydraulic motor corresponding to the oil delivery of the actual pump with a pressure drop in excess of that dictated by the load. The slide in the pressure reduction valve floats in a position determined by the fact that spring force plus the feed pressure of the actual pump, determined by the oil level in the expansion tank 5, balances with a desired and to the greatest degree intentional feed pressure of the hydraulic motors 2a, 2b on the delivery side of the actual pumps 1a, 1b. If the pressure in the delivery conduit of the pump decreases, the outgoing pressure of the pressure reduction valve, which pressure is substantially constant and determined by springs plus the oil level of the expansion tank, will control the slide so that this chokes to a greater degree. If the pressure in the delivery conduit of the pump increases above a desired value, the pressure reduction valve will automatically choke to a lesser degree so that the pressure in the delivery conduit of the pump decreases once more. The pressure reduction valve thereby ensures that the hydraulic motor, when this acts as pump, has sufficient feed pressure to prevent cavitation. Further, the pressure reduction valve prevents the actual pump 1a, 1b, which can be a constructionally simple type with fixed stroke volume and one delivery direction from having undesirable pressure on the return side. The feed pressure of the actual pump will, in all circumstances, be determined by the difference in height between the pump and the oil level of the expansion tank.

The pressure from the hydraulic motors on full effect of the manoeuvering valve lever will be transferred to the pilot valve 8. The said pilot valve which is adjusted to a relatively low opening pressure then controls the overflow valve 6. The hydraulic motors act as pump and brake the load with a factor determined by the relatively low adjusted opening pressure of the pilot valve 8, and deliver an oil amount equal to the sum of the oil delivery of the actual pump plus a variable oil amount which flows over the overflow valve 6. The oil amount flowing from the pressure side of the motor to the suction side over the overflow valve 6 will be automatically varied in accordance with variations in the load. An increase in the load will cause the overflow valve to open to a greater degree and a decrease in the load will result in the overflow valve opening to a lesser degree. The energy supply during the braking period will thereby, by the choking pressure reduction and overflow valve 6, be converted to heat which is supplied to the system.

By moving the manoeuvering valve lever from outer position which gives automatic control with relatively low braking factor, toward zero position, the slide of the manoeuvering valve to an increasing degree covers the return channel of the manoeuvering valve. The pressure in the hydraulic motors and thereby the braking factor then increases continuously and the r.p.m decreases correspondingly. Inasmuch as the choking of the oil flow from the hydraulic motors is transferred from the pressure reduction valve to the return channel of the manoeuvering valve, the pilot valve 8 loses the opening pressure. If the manoeuvering valve slide chokes to the degree that the pressure increases to the set opening pressure of the pilot valve 7, the overflow valve 6 opens and the hydraulic motor then brakes with full braking factor. By disposing the manoeuvering valve lever in stop position, the r.p.m. of the hydraulic motor decreases toward zero, with the exception of the internal leakage of the motor.

The advantages of the novel system are further elucidated hereinbelow in connection with its use for anchor winches with dynamic braking. In the subsequent explanation, it is assumed that each of the two hydraulic motors 2a, 2b illustrated has two chambers or two stages. The number of hydraulic motors can, of course, be increased as necessary.

When the chambers of the two hydraulic motors 2a, 2b are connected during a heaving operation, the pressure reduction valve 4 is maintained in open position by the working pressure so that return oil via the manoeuvering valve 3 is conveyed substantially without pressure back to the pumps 1a, 1b. The pilot-controlled safety valve 6 prevents overloading during heaving operation and determines the so-called stalling force in that the pilot valve 7 opens at set maximum pressure. The oil level in the expansion tank 5 prevents the pumps 1a, 1b from cavitating.

By means of one of the stage valves (not shown) one chamber of, for example, the motor 2b can be short-circuited on the pressure side. Only three of the four chambers of the two hydraulic motors then operate the winch. Similarly, by means of the stage valves, it is possible to connect the chambers of the motors so that only two of the four chambers of the two motors operate the winch. It is, of course, also possible to carry out a connection such that only one chamber of one motor is in action.

It can then be envisaged that the inlet and outlet of the motors are closed by the manoeuvering slide in the manoeuvering valve 3. The weight of the chain will then, via the winch, build up a static pressure in the four chambers of the two motors 2a and 2b. The pressure in the motors is, as stated, determined by the weight of the chain but restricted by the pilot valve 7 which is adjusted to maximum working pressure. The pilot valve 7 controls, as stated, the safety valve 6. The pump delivery from pumps 1a, 1b then circulates substantially without pressure through the by-pass-channels of the manoeuvering valve and back to the pumps.

In a braking operation, the manoeuvering lever is moved gradually from stop position to braking position. The manoeuvering slide then gradually exposes the return channel of the manoeuvering valve and chokes pressure oil from the hydraulic motors which are then, by the load, operated as pumps. The r.p.m. of the hydraulic motors is, in this manner, controlled continuously from zero and upwardly.

By gradually moving the manoeuvering valve lever toward braking position, the pressure in the motors is, to an increasing degree, transferred and choked by the pressure reduction valve 4, at the same time as the oil delivery of the pumps 1*a*, 1*b* no longer circulates freely through the by-pass-channels of the manoeuvering valve, since the manoeuvering slide is moved down and gradually closes the by-pass-channels. The pump delivery is, therefore, conveyed through the manoeuvering valve 3 to the four chambers of the motors 2*a* and 2*b*, at a feed pressure which prevents cavitation of the motors. The magnitude of the feed pressure is determined by a spring which acts on the slide of the pressure reduction valve in the reduction valve 4. The slide in the reduction valve floats in a position determined in that a spring force plus the return pressure balances with the feed pressure of the hydraulic motors 2*a* and 2*b*. If the filling pressure in the delivery conduit of the pumps 1*a*, 1*b* decreases, the pressure reduction slide will choke to a greater degree, so that the filling pressure increases. If the filling pressure in the delivery conduit of the pumps increases, the pressure reduction slide will choke to a lesser degree, so that the filling pressure decreases once more.

The pilot valve 8 is set at a relatively low opening pressure. When the pressure which is transferred to the pressure reduction valve 4 and which is also transferred to the pilot valve 8 increases to the opening pressure of the pilot valve 8, valve 8 will open and control the safety valve 6.

The hydraulic motors 2*a* and 2*b* act as pumps and brake the load, in that they deliver an amount of oil equal to the sum of the oil delivery of the actual pumps 1*a*, 1*b* plus a variable oil amount which flows over the safety valve 6.

If the manoeuvering valve lever is moved to outer position, the slide of the manoeuvering valve completely exposes the return channel of the manoeuvering valve. The pressure is then transferred from the motors 2*a* and 2*b* to the pressure reduction valve 4 and the pilot valve 8. The hydraulic motors act as pumps and brake the load with a minimum braking factor determined by the relatively low opening pressure of the pilot valve 8. The motors deliver an amount of oil equal to the sum of the oil delivery of the actual pumps 1*a*, 1*b* plus a variable amount of oil which flows over the safety valve 6.

If the load causes the hydraulic motors to rotate more rapidly than about 140 r.p.m., in a practical embodiment example, an alarm is given in that magnets 30, which rotate with the motor shaft, via a transducer 31, generate pulses which actuate a relay 32. The manoeuvering lever should then be moved from outer position so that an increasing pressure is built up in the hydraulic motors in order to brake and retard the load with increasing braking factor.

If the winch operator should lose control of the braking speed, the magnets 30, in the same embodiment example, at an r.p.m. of 150, via the transducer 31, actuate the relay 32 which actuate a solenoid operated valve 33. The solenoid operated valve 33 then drains the suction side of the pilot valve 8 so that this closes. The safety valve 6 then chokes at the set maximum pressure of the pilot valve 7. When the load is retarded corresponding to an r.p.m. of about 135, and the pulse frequency is less than that to which the relay 32 is adjusted, the solenoid operated valve 33 is no longer actuated. The pilot valve 8 will then open once more. In this manner, the r.p.m. is maintained within selected limits, even if the manoeuvering lever is maintained in outer position.

On final braking, the manoeuvering lever is moved gradually toward stop position. The slide of the manoeuvering valve then gradually closes the return channel of the manoeuvering valve and choking of pressure oil is, to an increasing degree, transferred from the pressure reduction valve 4 to the slide of the manoeuvering valve. The pilot valve 8 loses its opening pressure. The pressure in the hydraulic motors will, therefore increase until the pilot valve 7 opens at set maximum pressure. When the manoeuvering valve lever is moved to stop position, the entire amount of oil must flow through the safety valve 6 before the final stop. If the manoeuvering lever is moved to the stop position too rapidly or prematurely, the oil amount which is to flow through the safety valve 6 is too great. In these circumstances, a safety valve (not shown) opens at a pressure which is slightly higher than the maximum opening pressure of the safety valve 6.

Having described my invention, I claim:

1. A hydraulic system operating in combination with a winch, comprising at least two hydraulic motors connected in parallel for operation of the winch, pump means for supplying oil to the motors, a control valve for controlling the speed and direction of rotation of the motors, one of the motors having a dual capacity and a valve for selecting the capacity of the dual capacity motor, means for selectively coupling the motors to the oil supply to provide a plurality of speed ranges, a return connection for the oil to the pump, and means to restrict flow in the return connection to provide a braking action on the motors when the motors are driven by the load.

2. A hydraulic system as claimed in claim 1, said pump means comprising a plurality of fixed capacity pumps operating in parallel.

* * * * *